US005924822A

United States Patent [19]

Finn et al.

[11] Patent Number: 5,924,822

[45] Date of Patent: Jul. 20, 1999

[54] METHOD FOR DECK INSTALLATION ON AN OFFSHORE SUBSTRUCTURE

[75] Inventors: Lyle David Finn, Sugarland, Tex.; John Edwin Halkyard, Doway, Calif.; Edward E. Horton, III, Houston, Tex.

[73] Assignee: Deep Oil Technology, Incorporated, Houston, Tex.

[21] Appl. No.: 08/951,095

[22] Filed: Oct. 15, 1997

[51] Int. Cl.[6] ..... E02D 25/00

[52] U.S. Cl. ..... 405/209; 405/206; 114/258

[58] Field of Search ..... 405/204, 206, 405/209; 114/125, 49, 258, 259, 260, 264, 265, 266

[56] References Cited

U.S. PATENT DOCUMENTS

| | | | |
|---|---|---|---|
| 3,078,680 | 2/1963 | Wepsala | 405/209 |
| 4,176,614 | 12/1979 | Goss et al. | 114/125 |
| 4,232,625 | 11/1980 | Goren et al. | 114/165 X |
| 4,556,004 | 12/1985 | Lamy et al. | 114/258 X |
| 4,729,695 | 3/1988 | Silvestri | 405/204 |
| 4,825,791 | 5/1989 | Foster, Jr. et al. | 114/258 X |
| 4,909,174 | 3/1990 | Bowes | 114/265 |
| 5,403,124 | 4/1995 | Kocaman et al. | 405/209 |

FOREIGN PATENT DOCUMENTS

| | | | |
|---|---|---|---|
| 403235789 | 10/1991 | Japan | 114/265 |
| 2184402 | 6/1987 | United Kingdom | 114/265 |

*Primary Examiner*—David J. Bagnell
*Assistant Examiner*—Jong-Suk Lee
*Attorney, Agent, or Firm*—Robert J. Edwards; D. Neil LaHaye

[57] ABSTRACT

An apparatus and method for the installation of a deck on an offshore substructure. The invention is particularly useful with a floating substructure. Two independent pontoons each have two columns spaced apart from each other that extend upwardly from the pontoons. On each pontoon, a support beam attached to the columns spans the space between the columns. Each pontoon is provided with ballast tanks that allow the pontoons to be selectively ballasted or de-ballasted to control pontoon depth for receiving a deck or installing a deck on an offshore substructure. The pontoons may be ballasted down during transit of the deck such that the main body portion of the pontoons is below significant wave action and the columns present a relatively small water plane area. The pontoons allow the deck to be placed directly above the offshore substructure. For a floating substructure, the pontoons are ballasted while the floating substructure is simultaneously de-ballasted to transfer the deck to the floating substructure.

2 Claims, 7 Drawing Sheets

METHOD FOR DECK INSTALLATION ON AN OFFSHORE SUBSTRUCTURE

BACKGROUND OF THE INVENTION

1. Field of the Invention

The invention is generally related to the installation of offshore structures and more particularly to the installation of a deck on a substructure offshore.

2. General Background

In the construction and installation of offshore structures used in hydrocarbon drilling and production operations, it is much easier and less expensive to construct a large offshore structure on land and tow it to the site for subsequent installation than it is to construct the structure at sea. Because of this, every attempt is made to decrease the amount of offshore work that may be needed in an effort to minimize the cost of the structure. Regardless of these efforts, however, a certain amount of offshore work is still required in each case.

In the past, when the deck of a large offshore platform was to be installed, it was often found desirable to build the deck as one large component and install it fully assembled by lifting it from the tow barge and placing it upon the substructure. Unfortunately, as the decks became larger and heavier, there were fewer heavy-lift cranes that could handle such a load. If the deck became too large or heavy to be handled by cranes, it was divided into smaller components that were then each individually lifted into place. This prolonged the installation process since multiple lifts were required and, once in position, the equipment on the separate components had to be inter-connected and tested, thereby necessitating a large amount of offshore work.

An alternate method to dividing the deck into smaller components was to build the deck as a complete unit on shore and then skid this oversized deck onto a relatively narrow barge so that the sides of the deck extended beyond the edges of the barge. The barge would then be transported to the installation site where it would be maneuvered between the upright supports of the substructure (thus the need for a narrow barge and for a wide gap between the upright supports of the substructure). Once in place, the barge would be selectively ballasted, causing it to float lower in the water, and enabling the deck to come to rest upon the upright supports of the substructure. Afterwards, the barge would be moved out from under the deck and de-ballasted.

There are a number of disadvantages to this method. It is limited to a substructure with a large open area in its central region near the water line in order to accept the barge. The barge must also have sufficient beam width to provide stability against roll whenever the deck is supported on the barge. Thus, the substructure and barge, as well as the structural efficiency of the substructure and deck, are all interrelated.

The manner of ballasting the barge prior to transferring the deck onto the substructure also posed problems. The ballasting had to occur rather quickly, almost instantaneously, while the deck was properly located and aligned with respect to the substructure. Any sudden wave or wind force could cause such alignment to go astray or the barge's heave could cause damage to the deck or substructure.

With the advent of floating structures, such as spar type structures and TLP's (tension leg platforms), the ballasting of the vessel supporting the deck can not be carried out quickly. A large deck, for example, one that weighs 15,000 tons, will cause the floating substructure to move downward and, unless the floating substructure is de-ballasted to compensate for this increased weight, it will lose freeboard and could sink. To avoid this, large amounts of water must be pumped out of the floating substructure and this must be done rapidly to avoid repetitive slamming between the deck and the substructure if the seas are rough.

Applicants are aware of U.S. Pat. No. 5,403,124, which discloses a semi-submersible vessel for transporting and installing a deck of an offshore platform onto a substructure. The towing vessel is configured with a cutout or opening therein that surrounds the substructure onto which the deck is to be placed.

A disadvantage of the vessel in U.S. Pat. No. 5,403,124 is that it is limited to a certain maximum size of offshore structure in direct relation to the size of the vessel.

SUMMARY OF THE INVENTION

The invention addresses the above problems. What is provided is an apparatus and method for the installation of a deck on an offshore substructure. The invention is particularly useful with a floating substructure. Two independent pontoons each have at least two columns spaced apart from each other that extend upwardly from the pontoons. On each pontoon, a support beam attached to the columns spans the space between the columns. Each pontoon is provided with ballast tanks that allow the pontoons to be selectively ballasted or de-ballasted to control pontoon depth for receiving a deck or installing a deck on an offshore substructure. The pontoons may be ballasted down during transit of the deck such that the main body portion of the pontoons is below significant wave action and the columns present a relatively small water plane area. The pontoons allow the deck to be placed directly above the offshore substructure. For a floating substructure, the pontoons are ballasted while the floating substructure is simultaneously de-ballasted to transfer the deck to the floating substructure. The pontoons are then easily moved away from the offshore structure, de-ballasted, and then transported to a storage or building site for further use.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

Figure 1:
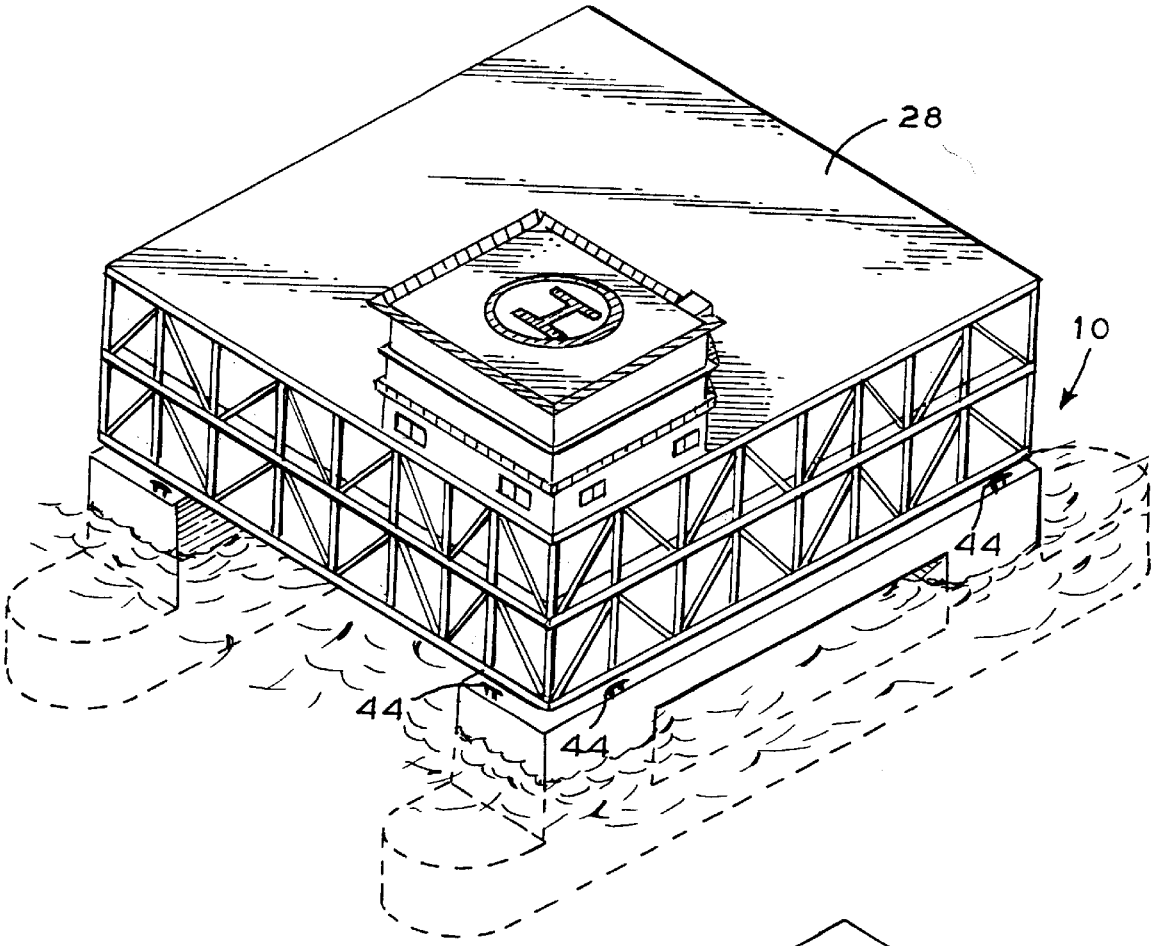
FIG. 1 is a perspective view of a deck on the pontoons of the invention.
Figure 2:
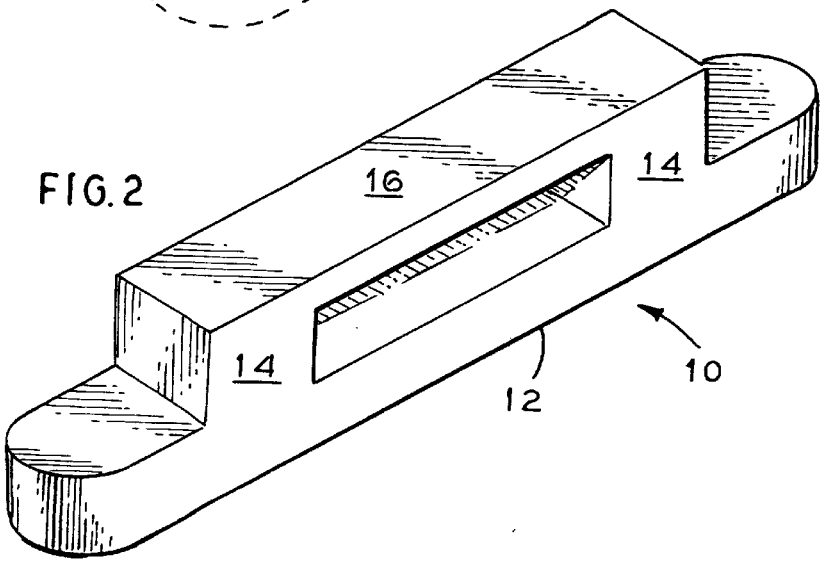
FIG. 2 is a perspective view of one of the pontoons of the invention.
Figure 3:
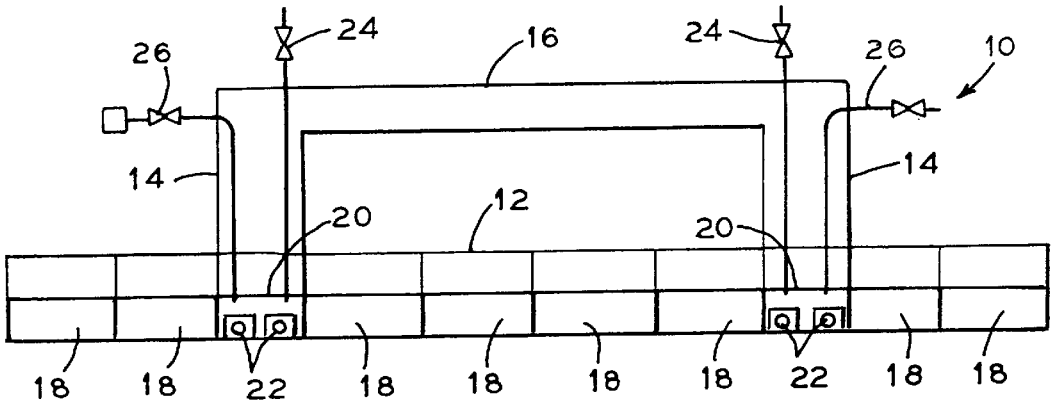
FIG. 3 is a side partial schematic view of a pontoon of the invention.

Referring to the drawings, it is seen in FIGS. 1–3 that the invention is generally indicated by the numeral 10. Although at least two buoyant pontoons 10 are required to carry out the invention, only one will be described since each pontoon is essentially identical.

Each pontoon 10 is formed from a main hull portion 12, two columns 14 which extend vertically from the main hull portion 12, and a support beam 16 which spans the columns 14.

As best seen in FIG. 3, the main hull portion 12 includes a plurality of separate ballast tanks 18 along the length of the main hull portion. Ballast tanks 18 are generally considered to be normal ballast tanks from the standpoint that they are not necessarily designed for rapid filling or emptying.

Rapid fill ballast tanks 20 are provided in columns 14. Vent lines 24 and compressed air injection lines 26 for rapid fill ballast tanks 20 are schematically illustrated in FIG. 3.

Figure 4:
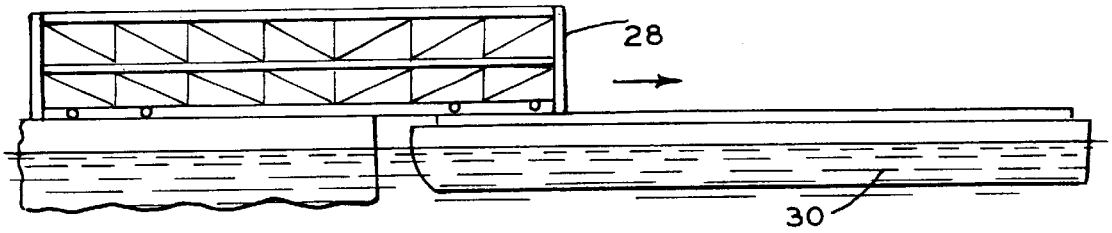
FIG. 4 illustrates a deck being skidded onto a barge.
Figure 5:
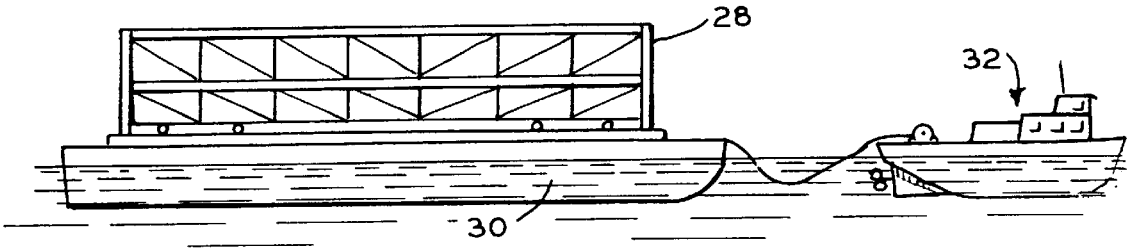
FIG. 5 illustrates the deck and barge of FIG. 3 in tow.

When required by water depth or transit distance, the deck 28 may first be loaded onto a transit barge 30 as illustrated in FIG. 4. The barge 30 and deck 28 are then towed by a self-propelled vessel 32 to water having a suitable depth (at least sixty feet) for transfer to the pontoons 10.

Figure 6A:
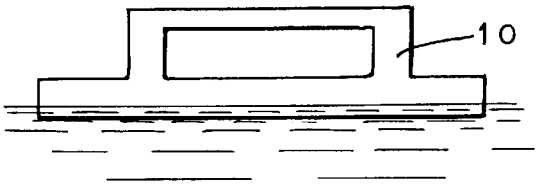
FIGS. 6A, B illustrate a pontoon of the invention at different drafts.
Figure 6B:
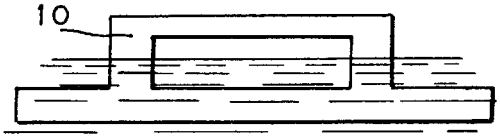
Figure 7A:
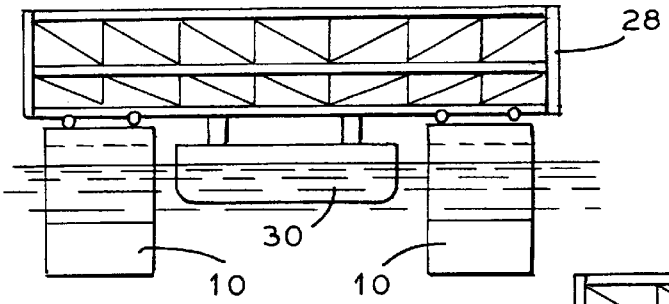
FIGS. 7A, B illustrate the transfer of the deck to the pontoons of the invention.
Figure 7B:
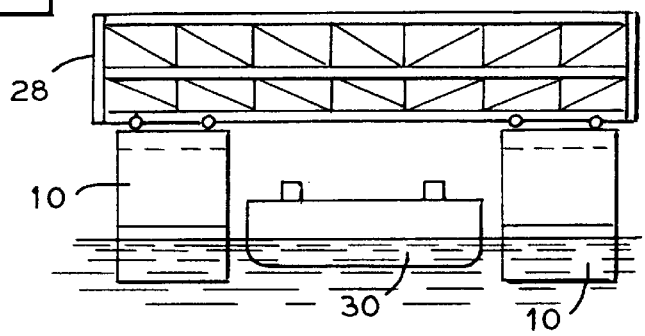

As seen in the side views of FIGS. 6A and 6B, the pontoons 10 are ballasted down until the tops of each of the pontoon's columns 14 and the support beams 16 can pass underneath the overhang portion of the deck 28 on either side of the barge 30. The pontoons 10 are then positioned on either side of the barge 30 under the deck 28 as seen in FIG. 7A. As seen in FIG. 7B, the pontoons 10 are de-ballasted to the extent necessary to raise the deck 28 clear of the barge 30. This operation could also include ballasting the barge 30 down to implement the de-ballasting of the pontoons 10.

Figure 8:
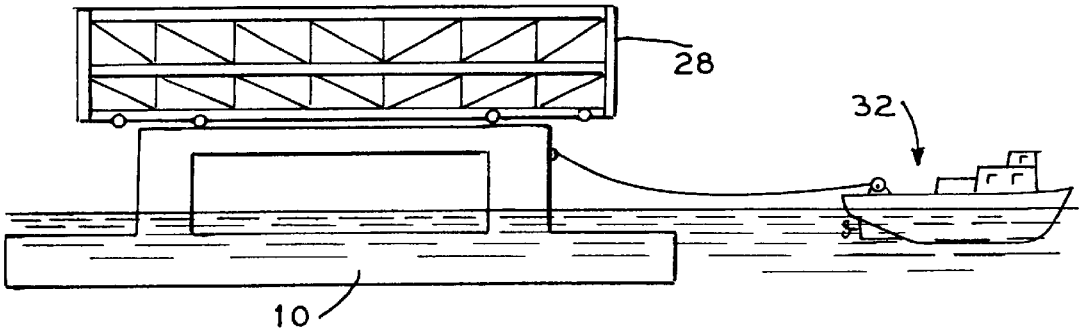
FIG. 8 illustrates the pontoons supporting the deck at a draft for transit in sheltered water.

Once the deck 28 is clear of the barge 30, the barge 30 is removed and the pontoons 10 are ballasted to a selected towing draft as seen in FIG. 8. This draft may be governed by the water depth of the route to open sea. For example, if the minimum water depth of the route were thirty feet, the towing draft of the pontoons 10 would be set to clear this depth.

Figure 9:
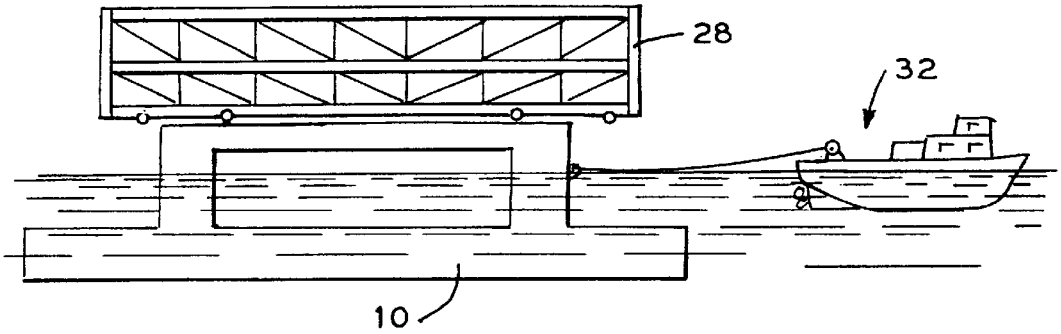
FIG. 9 illustrates the pontoons supporting the deck at a draft for transit in open water.

When the tow reaches deeper water and open sea, as seen in FIG. 9, the pontoons 10 are ballasted down to a draft which minimizes the motions of the pontoons 10 and deck 28. Normally, the water line for such an open sea tow will be approximately halfway between the top of the submerged pontoon 10 and the underside of the support beam 16. The pontoons 10 and deck 28 are then towed to the installation site. At this open sea tow draft, the pontoons 10 and deck 28 are able to withstand very severe seas because of the reduced water plane of the pontoon columns 14. Model tests show that the tow will withstand the seas having significant waves of forty feet without undergoing excessive motions.

Figure 10A:
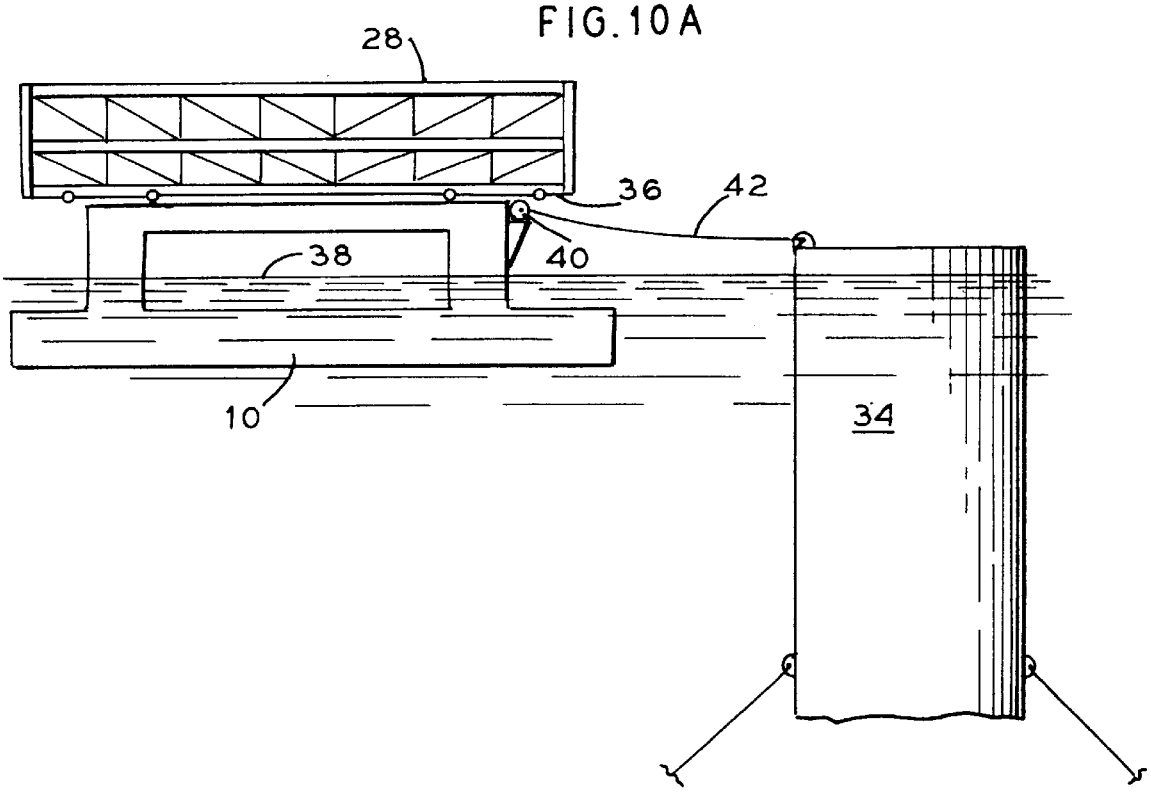
FIGS. 10A, B illustrate movement of the deck and pontoons above a floating structure.
Figure 10B:
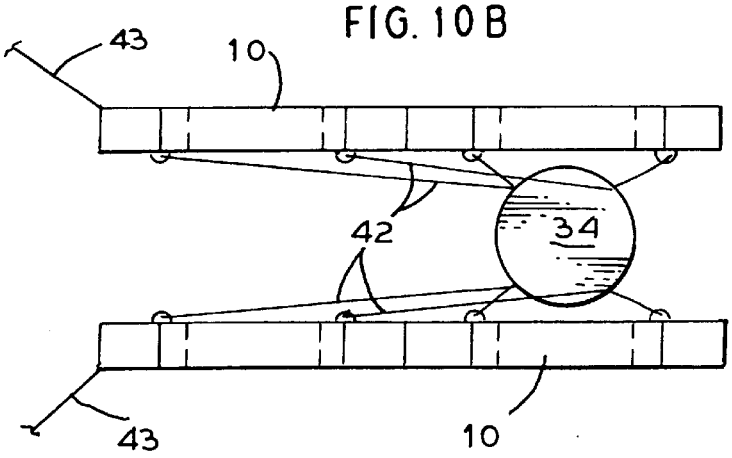

As seen in FIG. 10A, if the offshore substructure 34 is a floating substructure it is moored in place prior to the arrival of the deck 28 and also is ballasted down to a draft such that the top of the offshore substructure is below the lower mating surface 36 of the deck 28. This will tend to position the top of the floating offshore structure 34 approximately ten to fifteen feet above the water surface 38. A winch 40 and winch line 42 may be connected between the pontoons 10 and offshore substructure 34 for movement of the pontoons 10 and deck 28 relative to the offshore substructure 34. For ease of illustration, FIG. 10B does not include the deck 28. FIG. 10B illustrates the attachment points of winch lines 42 beyond the midpoint of the floating offshore structure 34, which is necessary to achieve the proper positioning of the deck 28. The movement of the pontoons 10 and winch lines 42 is shown in phantom view. Lines 43 may be used in conjunction with anchors or vessels to control swinging motions during the operation.

Figure 11:
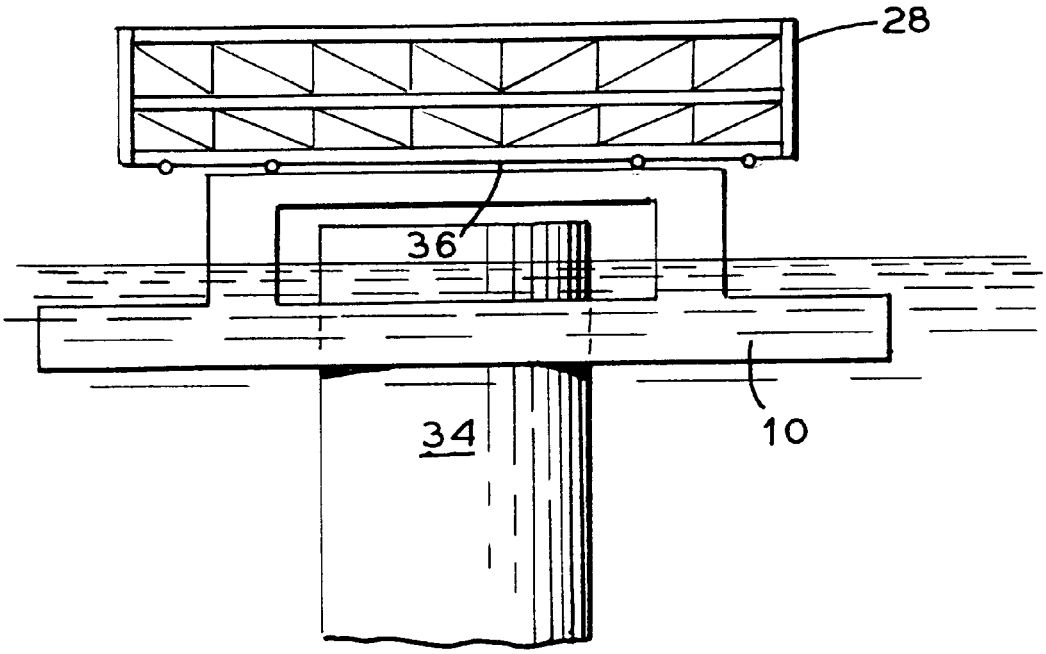
FIG. 11 is a side view of the deck and pontoons in position for the transfer of the deck to the offshore structure.
Figure 12:
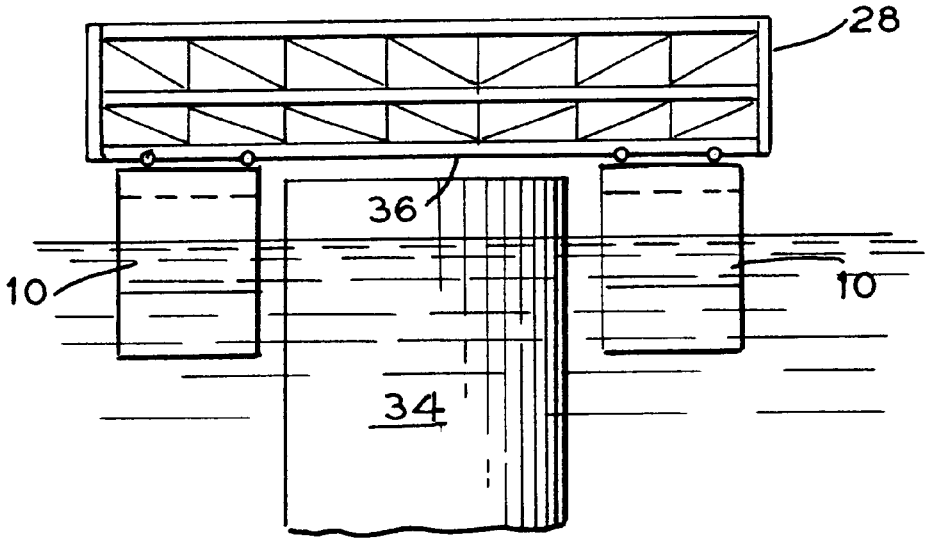
FIG. 12 is an end view of the structures in FIG. 11.
Figure 13:
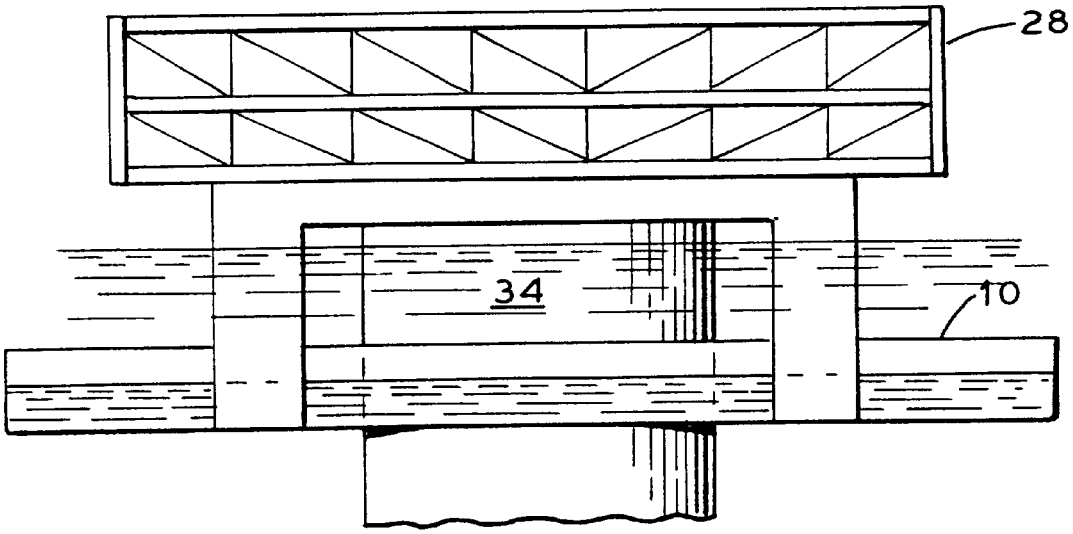
FIG. 13 is a side view illustrating contact between the deck and offshore structure during the transfer operation.
Figure 14:
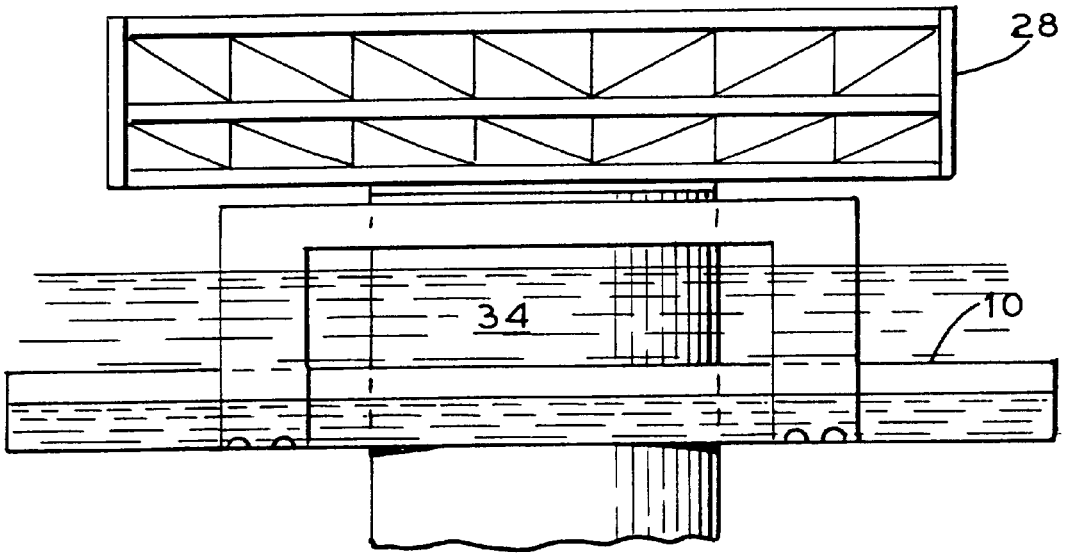
FIG. 14 illustrates the movement of the pontoons downward from the deck.

As seen in FIGS. 11 and 12, the pontoons 10 are moved to straddle the offshore substructure 34 such that the deck 28 is over the top of the offshore substructure 34.

A procedure for transferring load from the pontoons 10 to the substructure 34 is as follows: The pontoons 10 are positioned over the substructure 34 and the horizontal position is fixed with winch lines 42. The pontoons 10 are ballasted and/or the substructure 34 is de-ballasted until the deck 28 is within a docking distance of the substructure 34, typically about four feet. At this point, alignment pins become engaged with slots which insure proper contact points. When alignment is secured, the rapid flooding tanks are flooded to a sufficient amount of deck load to the substructure 34 to insure that operational waves will not cause separation and impact of the deck 28 and the substructure 34. Model tests have been performed showing that between ten to twenty percent of the deck load should be transferred in this step to mitigate impacts in seas between six to ten feet. This criteria, that the pontoons 10 must rapidly ballast through a four foot draft change and enough displacement to transfer ten to twenty percent of the deck weight to the substructure 34, sets the minimum volume for the rapid flooding tanks. Also, the rate of ballasting is limited by the size of openings 22 and the vent area 24 and these properties must be carefully considered in the design.

Once the required amount of initial deck load is transferred, the pontoons 10 may be ballasted and/or the substructure 34 de-ballasted at a slower rate with the criteria that the pontoon draft be maintained at a position of favorable responses, i.e. that the pontoons remain submerged and that the water plane intersect the columns with a suitable freeboard to the pontoon decks. At some point in the load transfer when the deck load on the substructure is between approximately forty to sixty percent, the rapidly flooding tanks on the pontoon need to be de-ballasted by supplying compressed air. This is because the rapid ballasting feature should be used again at the end of the load transfer to cause the pontoons to fall away from the deck quickly when all the load is transferred.

Figure 15:
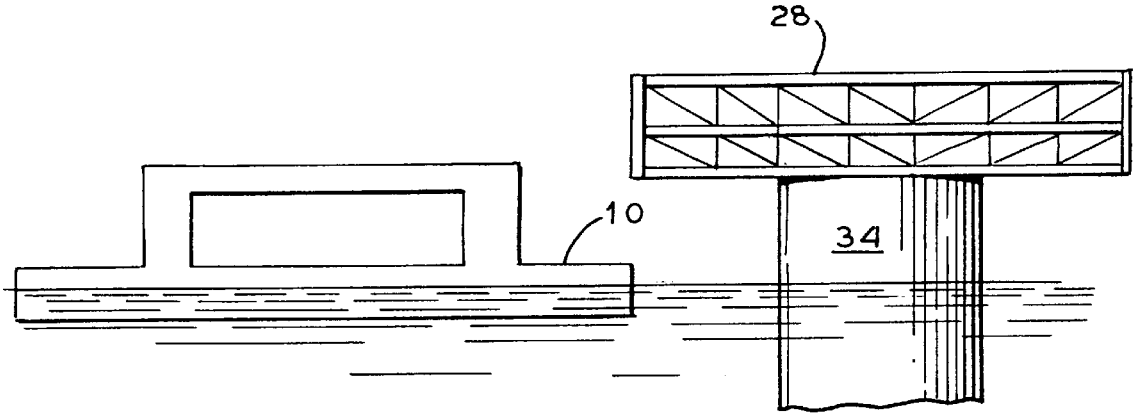
FIG. 15 illustrates the movement of the pontoons laterally away from the deck and floating offshore structure.

As seen in FIG. 15, the pontoons 10 are then moved away from the offshore substructure 34 and the offshore substructure 34 continues to be de-ballasted until it reaches a preselected operating draft. Final hook up between the offshore substructure 34 and deck 28 may then be made.

The above procedure may also be reversed to remove a deck from an offshore substructure and then transport the deck back to a dockside location. It should also be understood that it is possible to eliminate the use of the barge 30 when there is suitable water depth adjacent the fabrication site for direct loading of the deck 28 onto the pontoons 10.

Figure 16A:
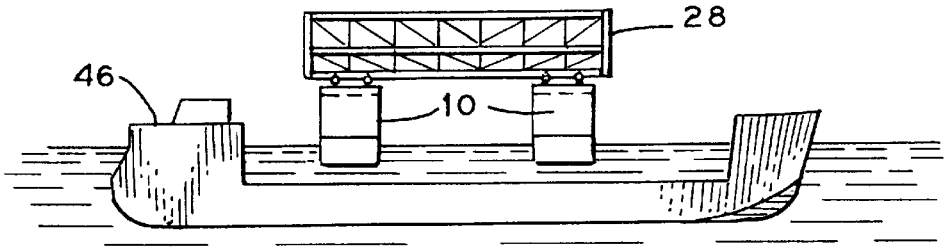
FIGS. 16A, B illustrate an alternate transit method which includes the use of a heavy lift semi-submersible vessel.
Figure 16B:
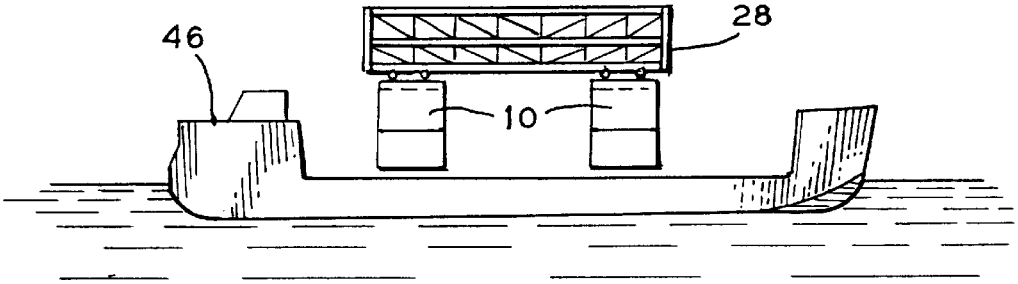

FIGS. 16A, B illustrate the use of a heavy lift vessel 46 in conjunction with the pontoons 10. The heavy lift vessel 46 is ballasted down and the pontoons 10, with deck 28 loaded thereon, are moved into position above the vessel 46. The vessel 46 is then de-ballasted and the pontoons 10 and deck 28 are secured to the vessel 46. This would be useful where the increased speed of the vessel 46 provides an advantage either relative to time constraints or the distance to the installation site. Once at the installation site, the pontoons 10 and deck 28 are floated off the vessel 46 and the deck installation is carried out as described above. As an alternative, the barge 30 may also be used in conjunction with the vessel 46 in the same manner as described for the pontoons 10.

It should be understood that the pontoons 10 may also be used to transfer the deck 28 to a fixed offshore substructure. The only difference is that the fixed offshore substructure is not de-ballasted.

The pontoons 10 are designed and proportioned to minimize wave-induced motion when supporting the deck 28 during the open sea to the installation site and during the time that the deck is floated over the offshore substructure for transfer thereto. The pontoons must have sufficient displacement to support the weight of the deck and must be stable throughout all ranges of draft. On pontoons designed to support a seventeen thousand ton deck, the normal ballast tanks are designed to take on and discharge ballast water at relatively normal rates (i.e.: fifty tons/minute). The rapid fill ballast tanks are designed to each hold five hundred tons of water. Typical dimensions for such pontoons would be as follows: two hundred fifty feet in length, forty feet in width, sixty feet tall at the columns, twenty feet tall at the lower portion of the pontoon, one hundred ten foot spacing between two columns, and one hundred fifty foot spacing between the outermost edges of two columns. Although the description and drawings refer to two columns on the pontoons, it should be understood that more than two columns may be provided on the pontoons if required.

An advantage of the invention, during installation, is the relatively large change in pontoon draft which may be achieved with relatively small amounts of ballasting/de-ballasting. For example, the dimensions described above indicates a total capacity of two thousand tons for the rapid fill ballast tanks. The water plane area for this case results in a draft change of approximately one foot for each one hundred fifty tons of ballast change. Thus, only six hundred tons of ballast needs to be taken on to close the initial four foot clearance between the deck and the floating substructure.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method for the installation of a deck on a floating offshore substructure, comprising the steps of:

a. placing the deck on a floating barge such that the deck extends beyond the edges of the barge;

b. providing at least two independent buoyant pontoons each formed from a main hull portion having two columns spaced apart from each other along the length of the hull and extending upwardly therefrom and a support beam between said columns;

c. ballasting said pontoons such that the support beams thereon are below a lower portion of the deck;

d. positioning said pontoons on both sides of the barge such that said pontoons are under the deck;

e. de-ballasting said pontoons such that said pontoons support the deck independently from the barge;

f. positioning said pontoons to straddle the floating offshore substructure such that the deck is above the top of the floating offshore substructure; and g. ballasting said pontoons and de-ballasting the floating offshore substructure to transfer the deck to the floating offshore substructure.

2. A method for the installation of a deck on an offshore substructure, comprising the steps of:

a. placing the deck on a floating barge such that the deck extends beyond the edges of the barge;

b. providing at least two independent buoyant pontoons each formed from a main hull portion having two columns spaced apart from each other along the length of the hull and extending upwardly therefrom and a support beam between said columns;

c. ballasting said pontoons such that the support beams thereon are below a lower portion of the deck;

d. positioning said pontoons on both sides of the barge such that said pontoons are under the deck;

e. de-ballasting said pontoons such that said pontoons support the deck independently from the barge;

f. positioning said pontoons to straddle the floating offshore substructure such that the deck is above the top of the floating offshore substructure; and g. ballasting said pontoons to transfer the deck to the floating offshore substructure.

* * * * *